US007371033B2

(12) United States Patent
Whitehead

(10) Patent No.: US 7,371,033 B2
(45) Date of Patent: May 13, 2008

(54) TWIN CHUCK DRILL WITH ONE DRIVE SHAFT

(75) Inventor: John Whitehead, Jerilderie (AU)

(73) Assignee: Whitehot Solutions Pty Ltd, Colombo Creek, Jerilderie, New South Wales (AU)

( * ) Notice: Subject to any disclaimer, the term of this patent is extended or adjusted under 35 U.S.C. 154(b) by 0 days.

(21) Appl. No.: 10/580,330

(22) PCT Filed: Mar. 25, 2004

(86) PCT No.: PCT/AU2004/000360

§ 371 (c)(1),
(2), (4) Date: May 24, 2006

(87) PCT Pub. No.: WO2005/049281

PCT Pub. Date: Jun. 2, 2005

(65) Prior Publication Data

US 2007/0098507 A1 May 3, 2007

(30) Foreign Application Priority Data

Nov. 24, 2003 (AU) ..... 2003906460

(51) Int. Cl.
*B35B 45/00* (2006.01)

(52) U.S. Cl. ..... 408/35; 173/46; 173/214

(58) Field of Classification Search ..... 408/35, 408/117, 124; 173/46, 214; 7/158, 165
See application file for complete search history.

(56) References Cited

U.S. PATENT DOCUMENTS 2,303,565 A * 12/1942 Luna ..... 173/214
2,919,609 A * 1/1960 Klingbeil ..... 408/117
5,573,358 A * 11/1996 Gobbers et al. ..... 408/35
6,506,002 B1 * 1/2003 Cummins ..... 408/35
6,715,969 B2 4/2004 Eriksen

FOREIGN PATENT DOCUMENTS

| | | |
|---|---|---|
| AU | 631615 | 10/1990 |
| DE | 4340740 | 6/1995 |
| DE | 20205898 U | 9/2002 |
| EP | 0673723 A | 9/1995 |
| FR | 2230444 | 12/1974 |
| GB | 2343646 A | 5/2000 |
| WO | WO 2004/105986 A1 | 12/2004 |

* cited by examiner

*Primary Examiner*—Daniel W. Howell
(74) *Attorney, Agent, or Firm*—Baker & Hostetler LLP

(57) ABSTRACT

A pistol grip drill (1) has two control triggers (3 and 9) on its hand grip (4). One trigger (3) controls power to a motor in a casing (2) of the drill and the other trigger (9) initiates a sequence which interchanges the positions of two chucks (20, 21). The chucks (20, 21) are mounted on a forward extension (8) of the casing (2). The extension (8) has two degrees of freedom. It is firstly capable of rotating through ninety degrees about the axis of a pivot (14) to bring the unused chuck to the driving position in front of the casing (2). The second degree of freedom allows the extension to be then rotated about the driving axis of a drill drive shaft (5) so that the displaced chuck is moved from an upwardly-pointing position to a downwardly position directly in front of the pistol grip. The interchanging of the chucks (20, 21) can be controlled by the hand of the user holding the hand grip (4).

4 Claims, 9 Drawing Sheets

TWIN CHUCK DRILL WITH ONE DRIVE SHAFT

FIELD OF THE INVENTION

The present invention relates to a pistol-grip tool having two chucks that are interchangeable in position, and is more specifically concerned with such a tool capable of being controlled by one hand of a user so that his/her other hand is freed for some other purpose.

BACKGROUND OF THE INVENTION

The use of a tool such as an electric drill, at an overhead position presents special problems. When drilling a hole it is often necessary to first form a pilot hole and then enlarge it with a second drill of larger diameter. If the user is standing on a ladder to form the pilot hole, it is necessary for him to descend the ladder if using a single chuck drill, and then replace the drill bit with one of larger size. The user must then ascend the ladder once again to find the pilot hole to be enlarged. If the pilot hole is not sufficiently deep for the larger drill, the whole process must be repeated.

The need for a tool having two chucks that are interchangeable in position has long been recognized and is the subject of a number of patented proposals. However these proposals have either resulted in a tool that is impracticable to use or which does not allow the user to interchange the positions of the chucks without using both hands. Thus the advantage of having one hand free for some other purpose, such as to hold a ladder the user may be standing on, is lost.

It is therefore an object of the present invention is to provide an improved two-chuck drill.

SUMMARY OF THE INVENTION

According to the present invention there is provided there is provided a pistol-grip tool having first and second chucks one of which may be replaced by the other at a common driving position; a releasable device operable to disconnect a rotary drive shaft from the chuck at the driving position when the chucks are to be interchanged; a chuck-changing unit operable with drive obtained from a drill motor, after the releasable device has been released, to re-position and then to turn it about the drive shaft axis to occupy a position in front of the pistol-grip bringing the second chuck from a position in front of the pistol-grip to the common driving position; and a mechanism operable by the same hand of the tool user as is holding the pistol-grip, to initiate operation of the chuck-changing unit and the disengagement and re-engagement of the releasable device so that the drive from the drive shaft is only imparted to the chuck at the driving position when the other chuck is occupying a position in front of the pistol-grip of the tool.

ADVANTAGE OF THE INVENTION

An advantage of the tool of the present invention is that the chuck not in use always occupies a position in front of the pistol-grip where it is stationary and allows normal operation of the tool. When it is required to interchange the positions of the chucks this may be carried out, for example, by the user depressing a second trigger on the pistol grip while the tool is not working. This can be arranged to initiate a control sequence that interchanges the positions of the chucks, and then restores the driving connection between the drive shaft and the chuck at the common driving position.

Preferably, the tool cannot transmit power from the drive shaft to either of the chucks until the chuck-interchange sequence has been completed.

BRIEF DESCRIPTION OF THE DRAWINGS

The invention will now be described in more detail, by way of example, with reference to the accompanying largely diagrammatic drawings; in which.

DETAILED DESCRIPTION OF THE PREFERRED EMBODIMENT

In the figures, corresponding parts of the drill have the same reference numbers.

The drill front end shown generally at 1 includes the forward portion of a drill casing 2 containing an electric motor (not shown) controlled by a trigger switch 3 mounted on a pistol-grip 4 that is gripped by one hand of a user when the drill is in use.

Figure 1:
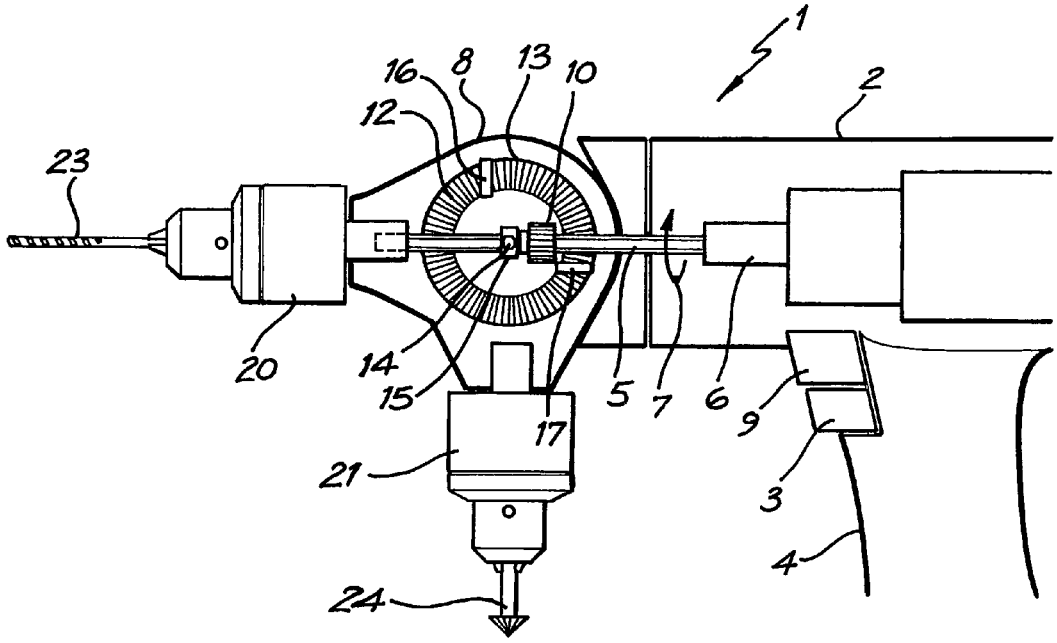
FIG. 1 is a cross-sectional side view of the front end of a pistol-grip drill made in accordance with a preferred embodiment of the present invention, the drill shown having a first chuck stationed at a position of use in front of the drill.
Figure 2:
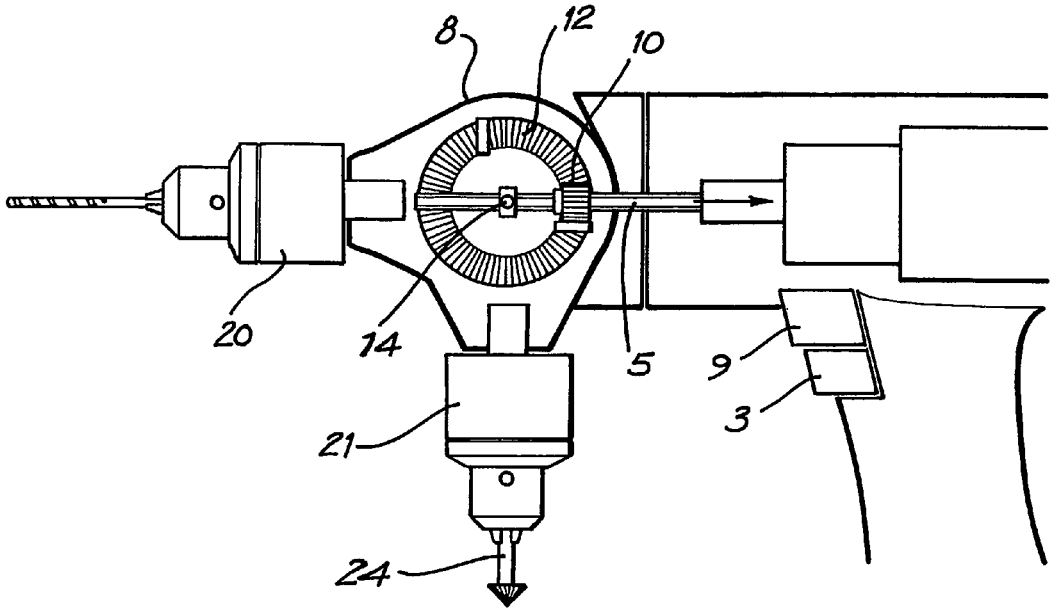
FIG. 2 is a similar view to that of FIG. 1, this time showing a first stage of a preferred automated process for interchanging the positions of the first and a second chuck of the drill.

The motor rotates a drill drive shaft 5 that can be reciprocated between two axially displaced positions, shown respectively in FIGS. 1 and 2, by a solenoid mechanism in a cylindrical box 6 surrounding the shaft 5. An arrow 7 shows the direction of rotation of the shaft 5.

The casing 2 has a forward extension 8 that can be rotated about the axis of the shaft 5 and also turned through ninety degrees in the same plane as the axis of the shaft. The shaft 5 carries a cylindrical gear 10 that reciprocates with the shaft and is rotated by it. The gear 10 has a ring of parallel teeth having tapered ends to assist their meshing with the teeth of a circular toothed track 12 extending around one side of a disc 13. In practice only one quarter of the length of track 12 is used. The track teeth also have tapered ends to assist their meshing with the gear 10. The disc 13 is pivotally mounted on a spindle 14 extending between the extension 8 and a collar 15 through which the shaft 5 is a close sliding fit. Opposite ends of the used section of the track 12 are respectively provided with stops 16 and 17 that limit the angle to which the gear 10 can travel around the track 12 when the shaft 5 is rotated.

As explained above, the connection between the casing 2 and the extension 8 allows the extension 8 two freedoms of movement. One freedom of movement includes a rotational movement of the extension 8 through 180.degree. about the axis of the shaft 5 as shown in successive FIGS. 4 to 8, and the second freedom of movement allows the extension 8 to rotate through ninety degrees about the axis of pivot 14 as shown in successive FIGS. 2 to 4.

The casing 8 carries two rotatable drill drive chucks 20 and 21 that project at right angles to one another, as shown in FIG. 1. The chuck 20 is shown in the driving position of the drill 1 and is illustrated supporting a conventional removable drill bit 23. The other chuck 21 is illustrated supporting a counter-sinking bit 24 at a position at which it extends downwardly forwardly of the pistol-grip 4 of the drill 1.

In the position of the drive shaft 5 illustrated in FIG. 1, the gear 10 is positioned forwardly of the track 12 so that the gear 10 and track 12 are not in mesh. However, if the mechanism in the box 6 is operated, the shaft 5 is retracted to the right of FIG. 1 bringing the teeth of the gear 10 into mesh with the teeth of the track 12. To establish a driving connection to the chuck 20,21 in use, the forward end of the shaft 5 is of hexagonal cross-section and fits within a socket of complementary cross-section of whichever of the chucks 20, 21 is in the driving position at the left-hand end of the drive shaft 5.

The operation of the chuck-changing mechanism shown in the drawings will now be described.

With the parts of the drill 1 in the positions shown in FIG. 1, the trigger 3 can be squeezed so that the drive from the drill motor (not shown) is transmitted through the shaft 5 to rotate the drill bit 23 in order to make a drill hole. When a drill hole of the appropriate depth has been formed, its mouth can be countersunk by bringing the chuck 21 and the countersinking bit 24 to the drive position in place of the drill bit 23. This is achieved by squeezing a second trigger 9 positioned above the trigger 3. It should be noted that a user of the drill 1 can squeeze the second trigger 9 with the same hand as is holding the pistol-grip 4 and operating the first trigger 3.

Figure 3:
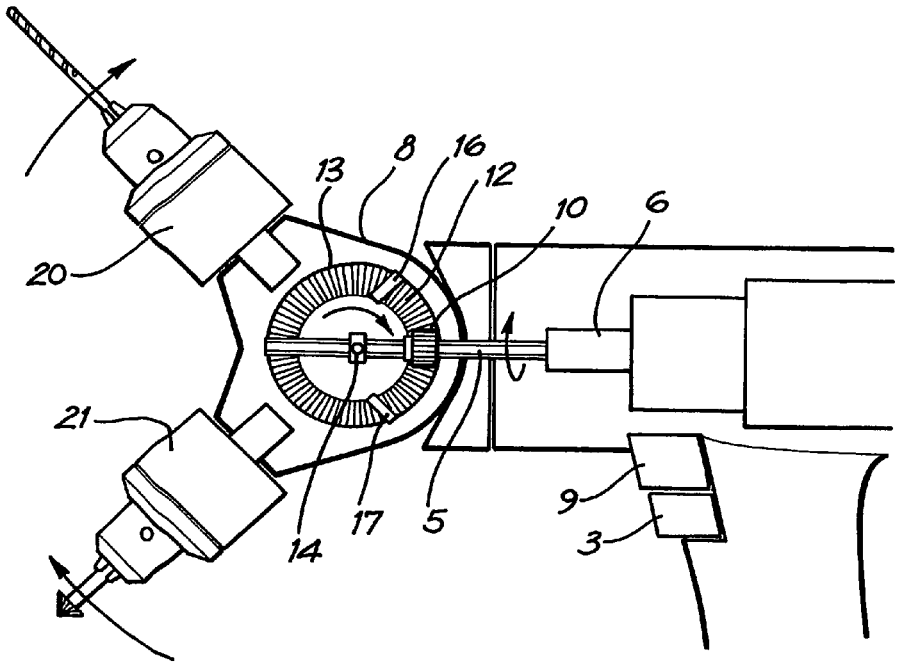
FIGS. 3, 4, 5, 6, and 7. are similar views to that of FIGS. 1 & 2, each showing a further stage of the preferred automated process of interchanging the positions of the first and second chucks of the drill.
Figure 4:
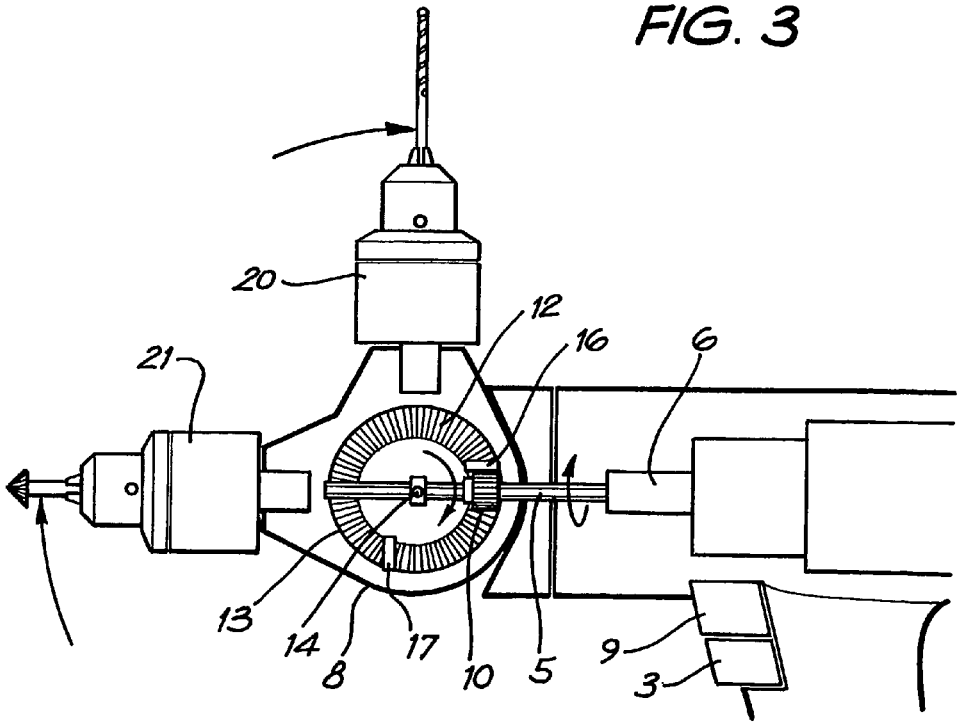
Figure 5:
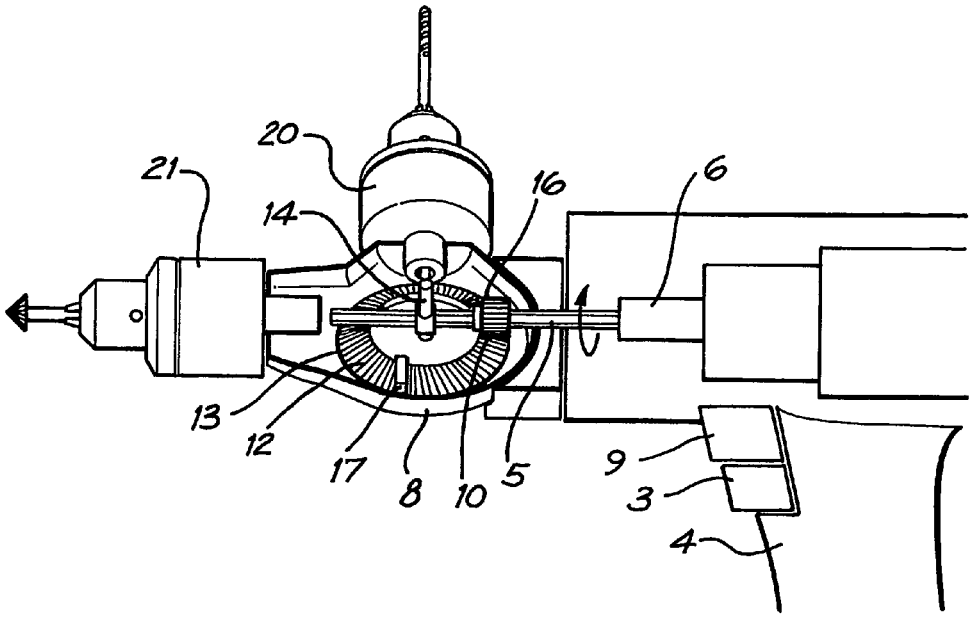
Figure 6:
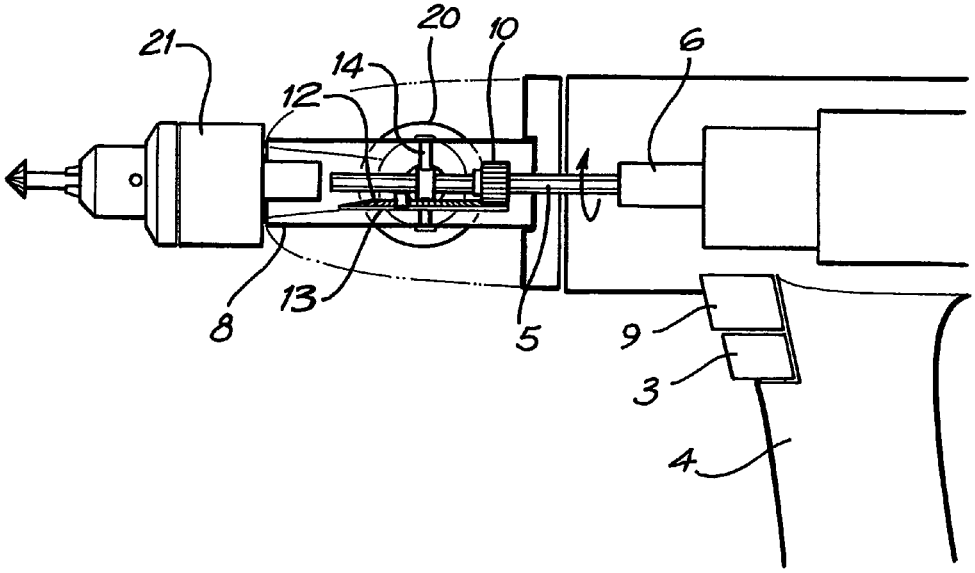
Figure 7:
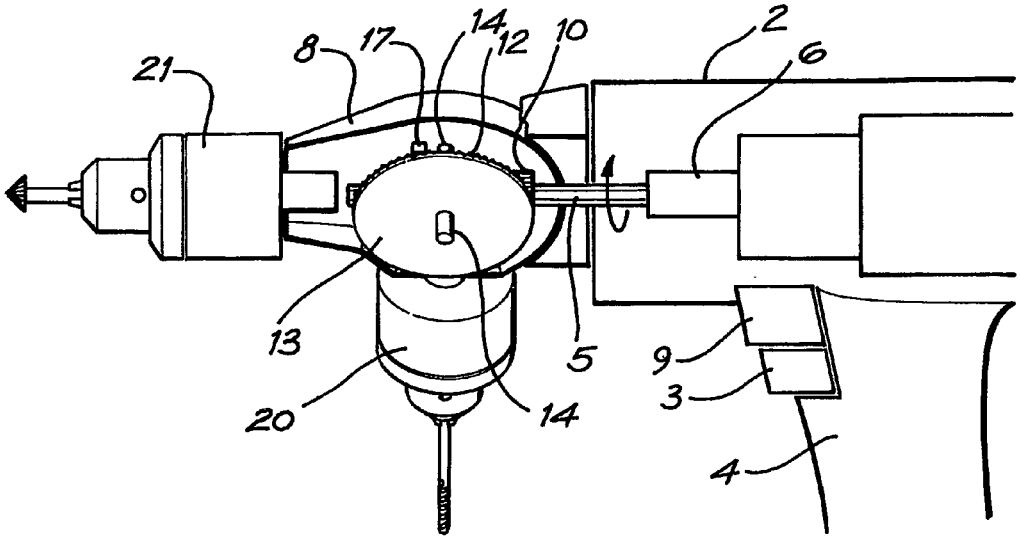
Figure 8:
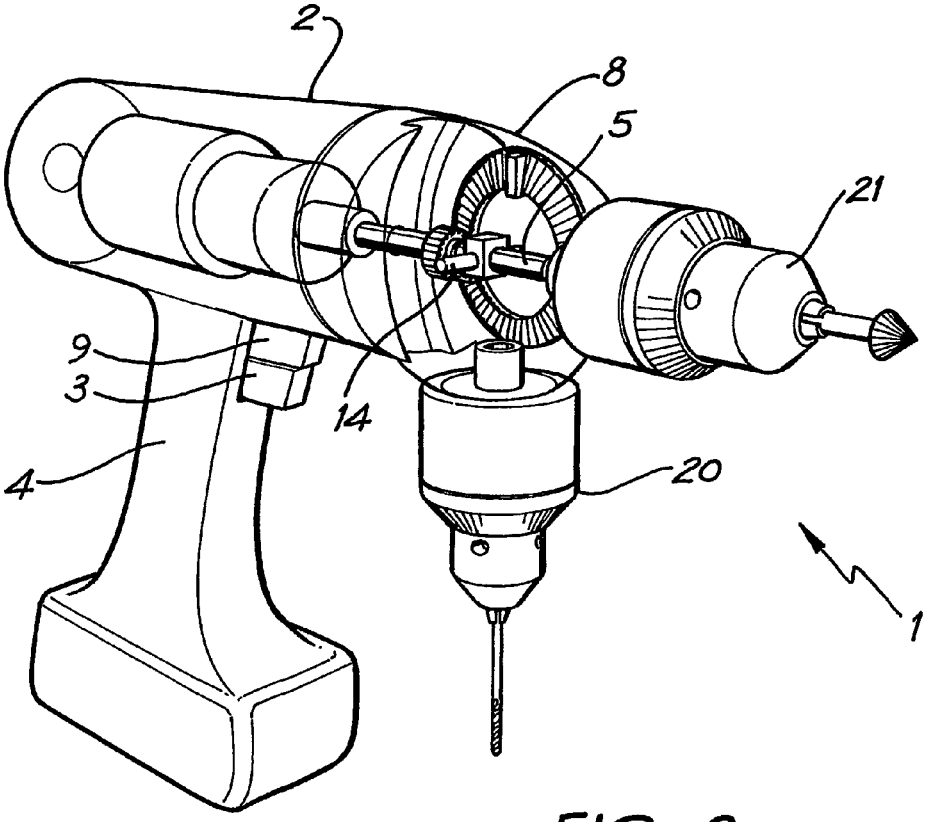
FIG. 8 is a cross-sectional front perspective view of the drill of FIGS. 1 to 7, this time showing the second chuck stationed at the position of use in front of the drill after the position of the first and second chucks has been interchanged.

The action of pressing the trigger 9 is to energise a sequencing circuit that carries out the following steps: The drill drive motor is first temporarily de-energised and the mechanism in the box 6 is operated against the resilient bias of a spring (not shown) to withdraw the forward end-portion of the shaft 5 from the socket in the chuck 20. Simultaneously the gear 10 is brought into mesh with the teeth of the used section of the track 12. This is shown in FIG. 2. The user maintains the trigger 9 depressed and the sequencing circuit then re-energises the driving motor (not shown) so that the gear 10 is rotated to drive the disc 13 in its own plane in a clockwise direction by way of the meshing gear 10 and track 12. This displaces the two chucks 20,21 angularly so that the chuck 21 moves towards the driving position formerly occupied by chuck 20 and the chuck 20 moves towards a vertically upward position. Successive stages in this movement are shown in FIGS. 3 and 4. When the chuck 20 reaches the position shown in FIG. 4, the gear 10 abuts the stop 16 so that further rotation of the disc 13 about the axis of the spindle 14 is prevented. One freedom of movement of the extension 8 has then been completed.

Figure 9:
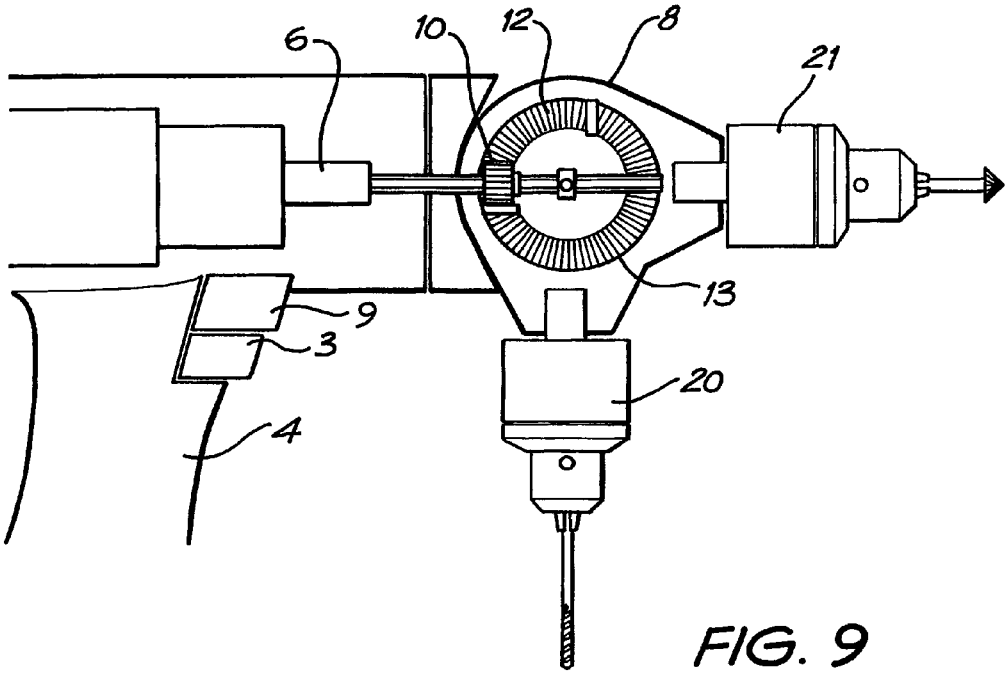
FIGS. 9 & 10 are cross-sectional side views of the drill of FIGS. 1 to 8, again showing the second chuck stationed at the position of use in front of the drill, but this time illustrating the final stages of the preferred automated chuck change process; and, FIGS. 11, 12, 13, 14, 15, 16, 17, and 18. are cross-sectional side views of the drill shown in FIGS. 1 to 10, this time showing a preferred automated process for returning the first chuck to the position of use in front of the drill, each figure showing a different stage of the preferred return automated chuck change process.
Figure 10:
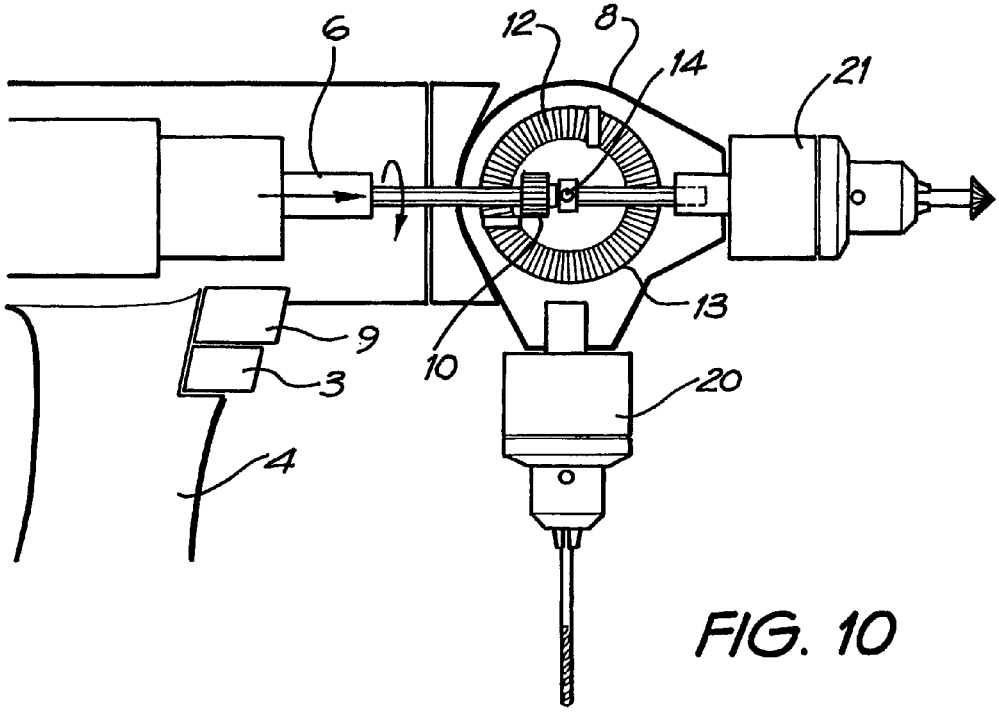

As the gear 10 cannot rotate further along the track 12, further rotation of the drive shaft 5 causes the extension 8 and disc 13 to rotate bodily around the axis of the drive shaft 5. This moves the chuck 20 from the position shown in FIG. 4 through the successive positions shown in FIGS. 5, 6 and 7 to the position shown in FIG. 8 at which the chuck 20 is positioned directly in front of the pistol-grip 4. During this rotation of the chuck 20 the second chuck 21 remains in the driving position of the drill 1 as shown. Once the chuck 20 has reached the position shown in FIGS. 8 and 9, a mechanical switch (not shown) is operated by the extension 8 to stop operation of the mechanism in the box 6 and de-energise the drill drive motor (not shown). The spring (not shown) associated with the mechanism in the box 6 then advances the front-end of the drive shaft towards the front of the drill 1. This forward movement of the drive shaft 5 disengages the gear from the track 12 (as shown in FIG. 10), and the forward end of the drive shaft 5 then enters the socket in the back of the chuck 21 to establish a driving engagement between the drive shaft 5 and the chuck 21. On completion of this movement of the shaft 5, the forward movement of the drive shaft 5 operates a switch (not shown) to allow the operation of the trigger 3 to energise the drive motor (not shown) once again and enable the countersinking bit 24 in the chuck 21 to be used.

Figure 11:
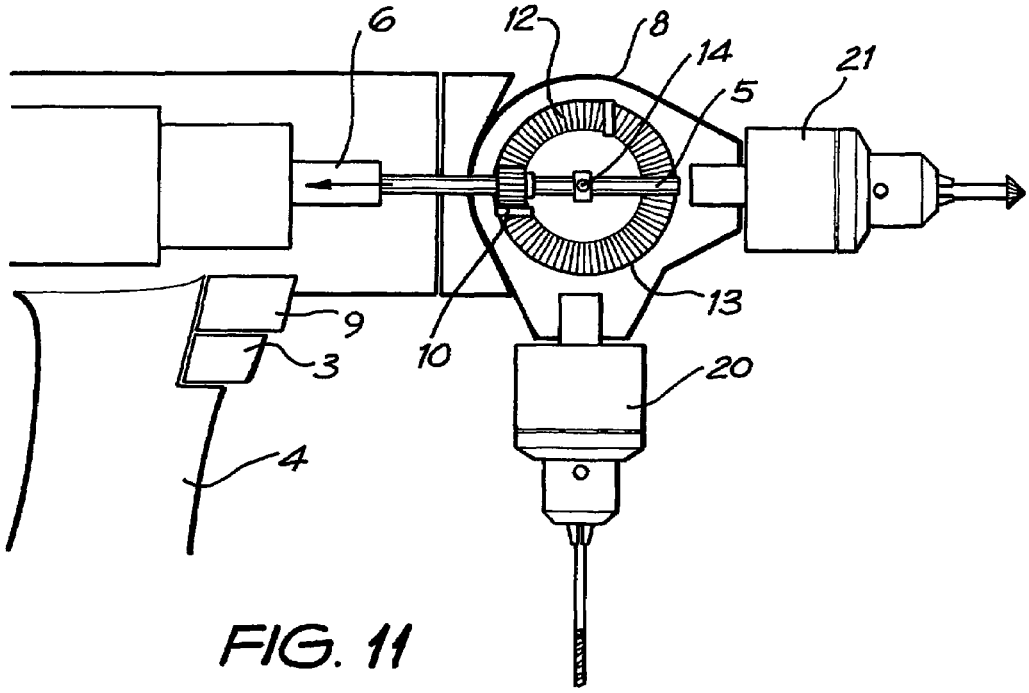
Figure 12:
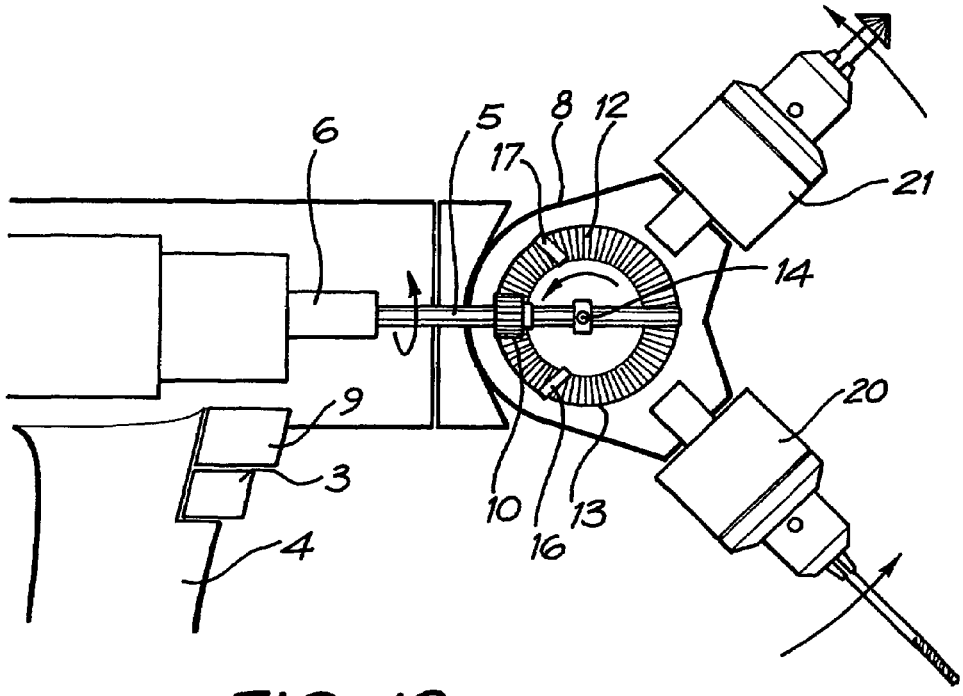

If it is again required to interchange the positions of the chucks 20 and 21, the above procedure is repeated as shown in the sequence of FIGS. 11 to 18. The mechanism in the box 6 is operated to withdraw the drill shaft 5 from the chuck 21 against the force of the resilient spring bias (not shown), and to temporarily de-energise the electrical circuit to prevent operation of the drill motor (not shown) from the trigger 3. As shown in FIG. 11 the withdrawal movement of the shaft 5 brings the gear 10 into mesh once again with the teeth of the arcuate track 12 as shown in FIG. 11. When the trigger 9 is now squeezed, the electrical circuit to the motor (not shown) is again energised by the sequencing circuit but in a way which reverses its direction of rotation. The shaft 5 is now rotated in the direction indicated by the arrow in FIG. 12, to rotate the disc 13 in a counterclockwise direction, as shown in FIG. 12, about the axis of the spindle 14.

Figure 13:
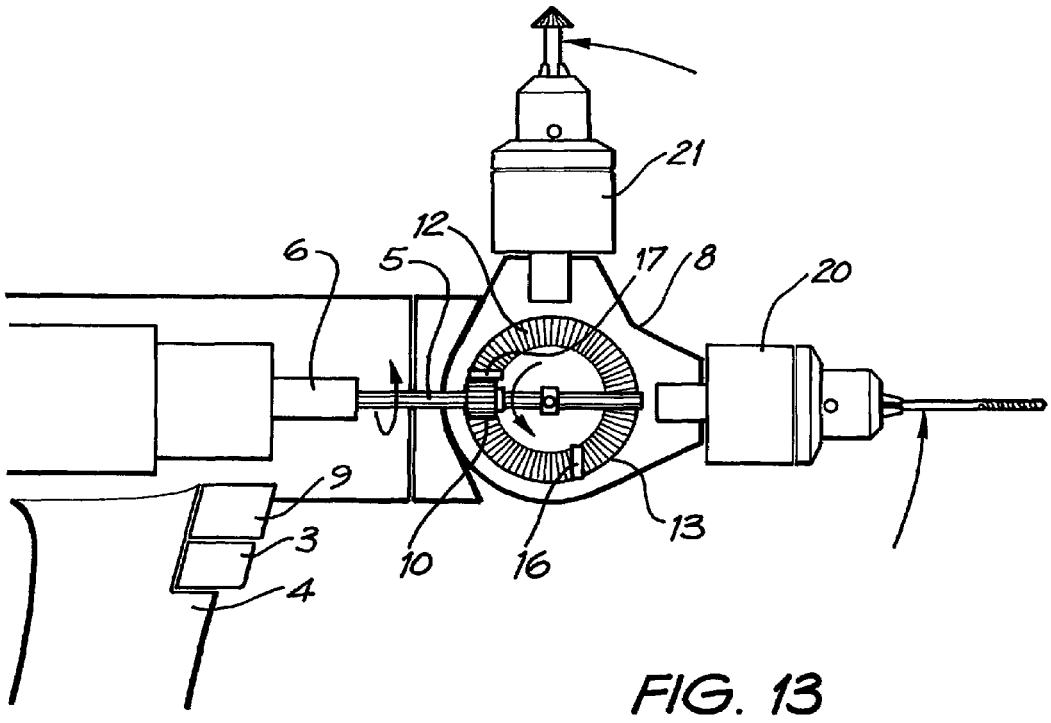
Figure 14:
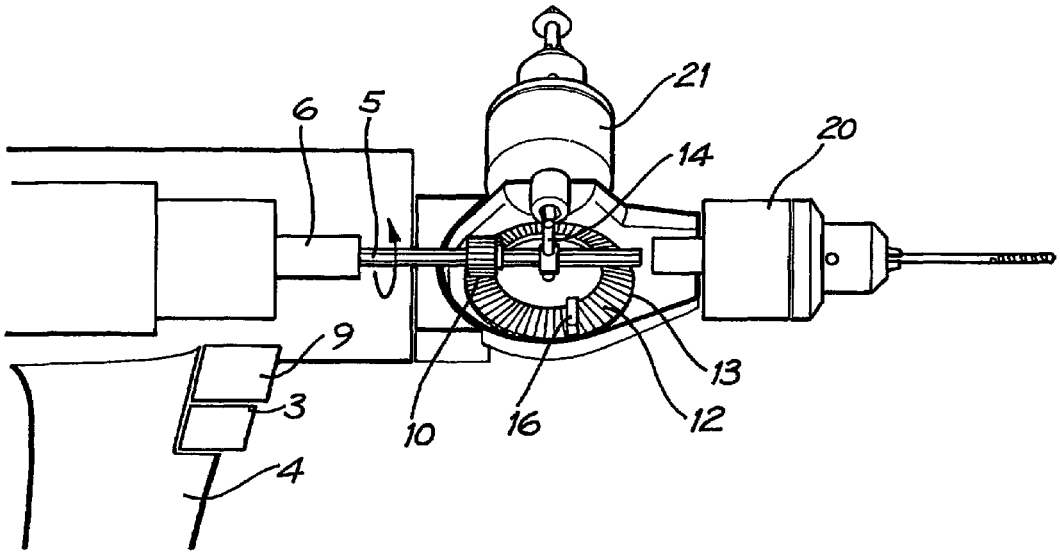
Figure 15:
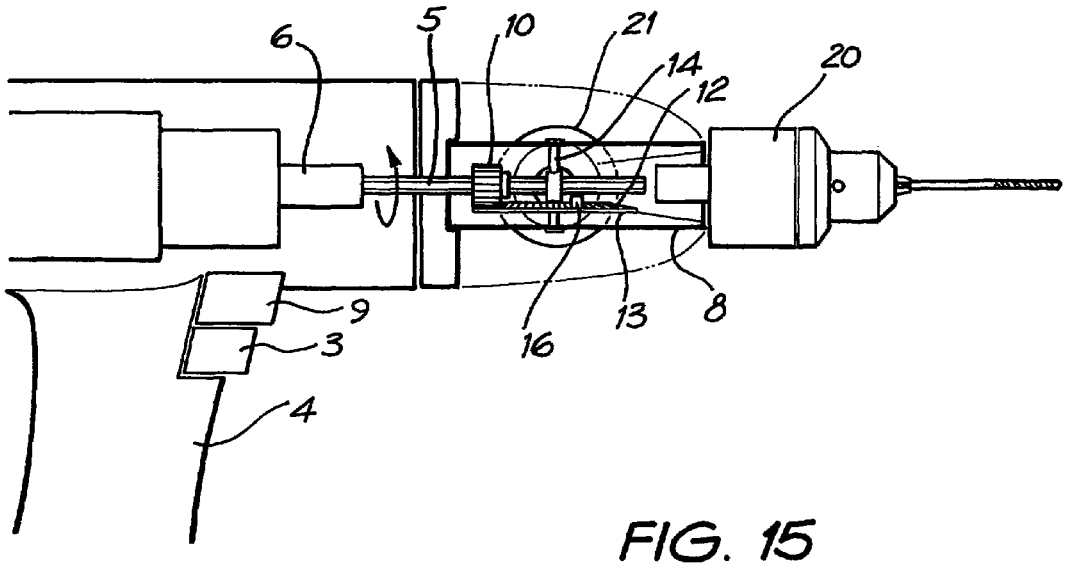
Figure 16:
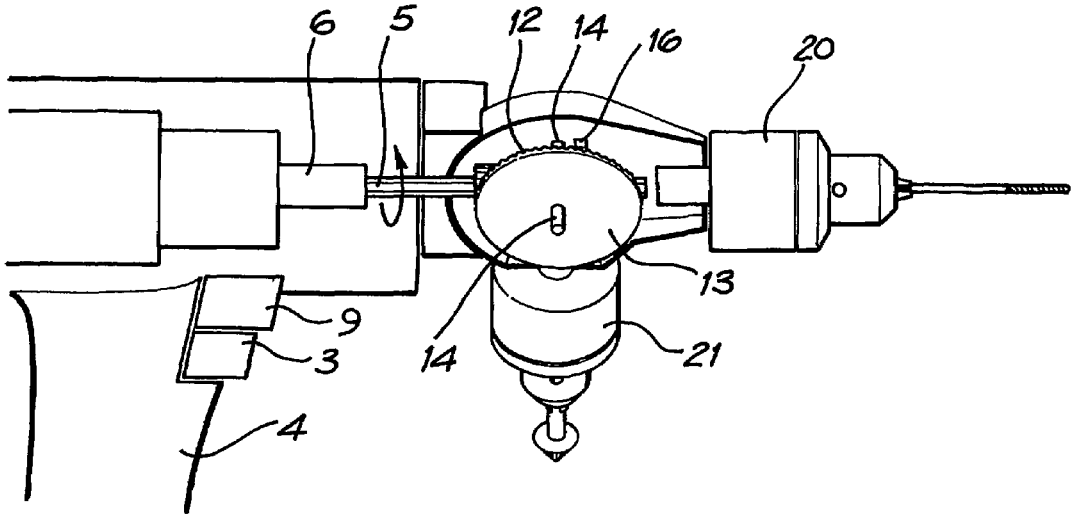
Figure 17:
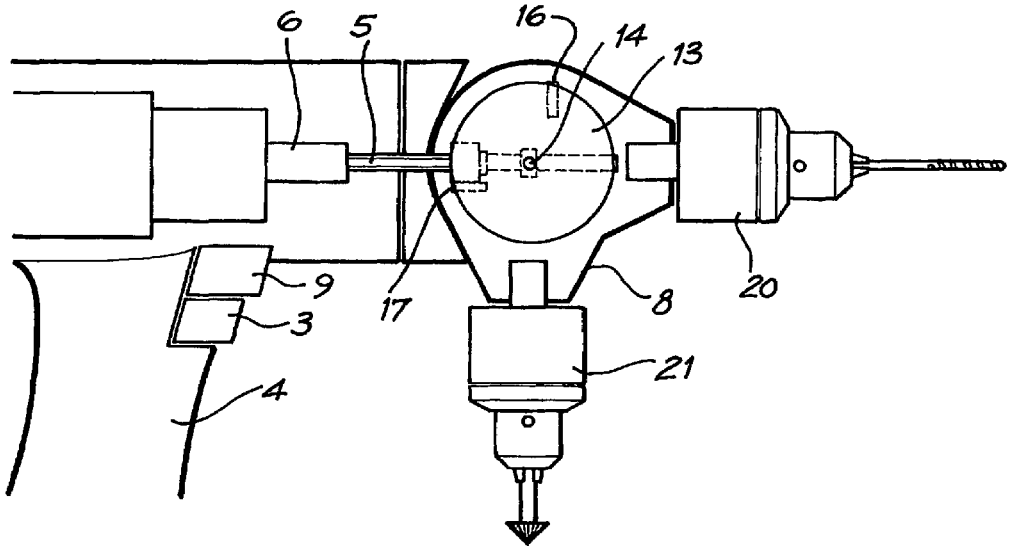
Figure 18:
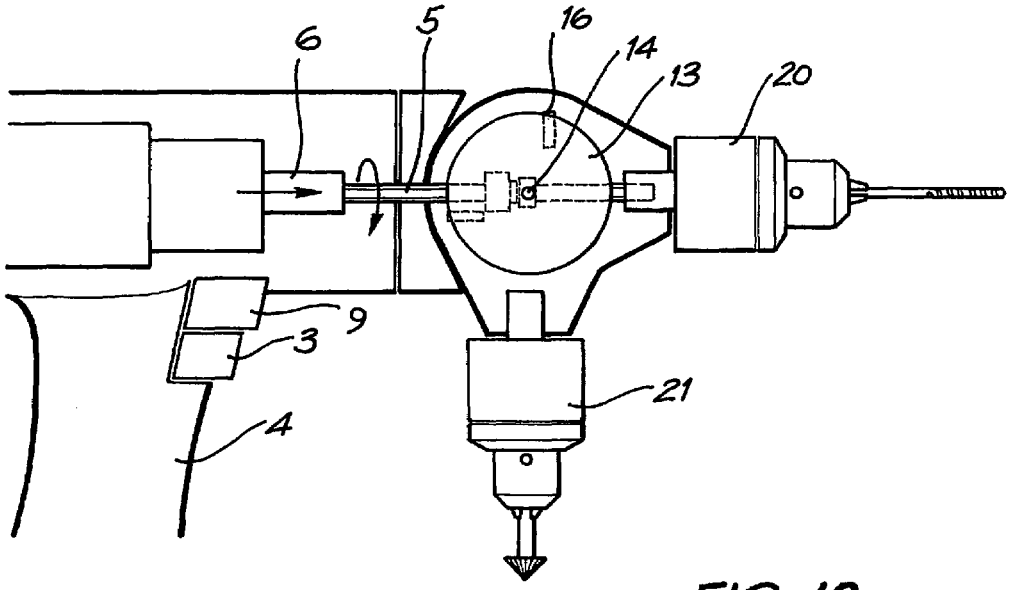

The counterclockwise movement of the disc 13 moves the chuck 21 upwardly and brings the chuck 20 into alignment with the drive shaft 5, as shown in FIG. 13. This movement is completed when the track 12 has turned through ninety degrees and the gear 10 abuts the stop 17 at the end of the track 12. When this occurs, further rotation of the track 12 is prevented and the turning movement of the shaft 5 is imparted to turn the disc 13 and extension 8 bodily about the axis of the shaft 5. This brings the chuck 21 from a vertically upwards position shown in FIG. 13, through the stages shown in FIGS. 14, 15 and 16, to the vertically downwards position shown in FIG. 17 when it is located a short distance in front of the pistol-grip 4. This movement is terminated by the actuation of a switch (not shown) responsive to movement of the extension 8. The mechanism in the box 6 is de-energised by the switch to allow the resilient spring bias (not shown) on the shaft 5 to move the shaft 5 axially in a forward direction to bring its free end-portion into engagement with the socket at the back of the chuck 20. Simultaneously the gear 10 is disengaged from the track 12 and the parts of the drill 1 assume the positions shown in FIG. 18. The trigger 9, which initiated the interchange of the two chucks 20 and 21, is then released automatically by the forward movement of the shaft 5 to allow the drill 1 to be again operated by squeezing the trigger 3.

In a modification (not shown) of the above-described arrangement, the extension 8 carries two opposed spaced parallel tracks 12 which share a common axis of rotation and respectively mesh with the teeth of the gear 10 on its opposite sides. The gear 10 is thus trapped between the two tracks so that a dynamically strong arrangement results in which the risk of the teeth of the gear 10 being forced out of engagement with the teeth of the tracks 12 when under load, is greatly reduced. The additional track 12 used in this modification turns freely about the axis of the spindle 14 and thus is simply an idler and does not participate in the transmission of drive between the shaft 5 and the chuck 20/21 at the driving position in front of the extension 8.

The invention claimed is:

1. A pistol-grip tool having first and second chucks one of which may be replaced by the other at a common driving position; a releasable device operable to disconnect a rotary drive shaft from the chuck at the driving position when the chucks are to be interchanged; a chuck-changing unit operable with drive obtained from a drill motor, after the releasable device has been released, to re-position and then to turn it about the drive shaft axis to occupy a position in front of the pistol-grip bringing the second chuck from a position in front of the pistol-grip to the common driving position; and a mechanism operable by the same hand of the tool user as is holding the pistol-grip, to initiate operation of the chuck-changing unit and the disengagement and re-engagement of the releasable device so that the drive from the drive shaft is only imparted to the chuck at the driving position when the other chuck is occupying a position in front of the pistol-grip of the tool.

2. The pistol-grip tool as claimed in claim 1, further including a finger button alongside the pistol-grip which can only operate the releasable device when the drive shaft is not rotating.

3. The pistol-grip tool as claimed in claim 1, further including a part which carries the chucks and which has two degrees of freedom so that it is bodily rotatable about the drive shaft and is also rotatable in its own plane.

4. The pistol-grip tool as claimed in claim 3, wherein said part carries a rotatable disc having an arcuate section of a toothed track, and the releasable device includes a gear through which the drive shaft is slidable without relative rotation and which is displaceable into and out of mesh with the arcuate section of the track by reciprocation of the drive shaft.

* * * * *